US010018051B2

(12) United States Patent
Ahmad et al.

(10) Patent No.: US 10,018,051 B2
(45) Date of Patent: Jul. 10, 2018

(54) GAS TURBINE AND MOUNTING METHOD

(71) Applicant: Siemens Aktiengesellschaft, Munich (DE)

(72) Inventors: Fathi Ahmad, Kaarst (DE); Michael Händler, Erkrath (DE); Kevin Kampka, Mulheim a. d. Ruhr (DE); Christian Kowalski, Oberhausen (DE); Christian Kowalzik, Berlin (DE); Nihal Kurt, Dusseldorf (DE); Stefan Schmitt, Mulheim an der Ruhr (DE); Peter Schröder, Essen (DE)

(73) Assignee: Siemens Aktiengesellschaft, Munich (DE)

( * ) Notice: Subject to any disclaimer, the term of this patent is extended or adjusted under 35 U.S.C. 154(b) by 293 days.

(21) Appl. No.: 15/023,391

(22) PCT Filed: Aug. 29, 2014

(86) PCT No.: PCT/EP2014/068359
§ 371 (c)(1),
(2) Date: Mar. 20, 2016

(87) PCT Pub. No.: WO2015/043876
PCT Pub. Date: Apr. 2, 2015

(65) Prior Publication Data

US 2016/0201497 A1 Jul. 14, 2016

(30) Foreign Application Priority Data

Sep. 25, 2013 (EP) ..... 13185947

(51) Int. Cl.
*F01D 11/08* (2006.01)
*F01D 5/02* (2006.01)
(Continued)

(52) U.S. Cl.
CPC ..... *F01D 5/143* (2013.01); *F01D 5/02* (2013.01); *F01D 5/12* (2013.01); *F01D 11/08* (2013.01);
(Continued)

(58) Field of Classification Search
CPC ... F01D 5/02; F01D 5/12; F01D 5/143; F01D 11/08; F01D 21/003; F05D 2220/32; F05D 2230/60; F05D 2260/30; F05D 2260/83
See application file for complete search history.

(56) References Cited

U.S. PATENT DOCUMENTS 2,685,429 A 8/1954 Auyer
3,656,862 A 4/1972 Rahaim et al.
(Continued)

FOREIGN PATENT DOCUMENTS

CN 102477871 A 5/2012
EP 0132182 A1 1/1985
(Continued)

OTHER PUBLICATIONS

JP Notice of Allowance dated Sep. 11, 2017, for JP patent application No. 2016-516887.
(Continued)

*Primary Examiner* — Igor Kershteyn
(74) *Attorney, Agent, or Firm* — Beusse Wolter Sanks & Maire

(57) ABSTRACT

An insert element fastens to an annular segment body of a turbine of a gas turbine. The annular segment body has a recess on a hot-gas side. The insert element is designed to cover the recess and has a concave front side and a rear side having at least one shaped portion for positioning on the annular segment body. An annular segment has the insert
(Continued)

element, a gas turbine has the insert element, and a mounting method mounts the insert element.

8 Claims, 3 Drawing Sheets

(51) Int. Cl.
*F01D 5/12* (2006.01)
*F01D 5/14* (2006.01)
*F01D 21/00* (2006.01)

(52) U.S. Cl.
CPC ..... *F01D 21/003* (2013.01); *F05D 2220/32* (2013.01); *F05D 2230/60* (2013.01); *F05D 2260/30* (2013.01); *F05D 2260/83* (2013.01)

(56) References Cited

U.S. PATENT DOCUMENTS 4,565,492 A 1/1986 Bart et al.
4,863,345 A * 9/1989 Thompson ..... F01D 11/18 415/134
5,165,848 A * 11/1992 Plemmons ..... F01D 25/145 29/888.01
5,174,714 A * 12/1992 Plemmons ..... F01D 25/145 29/888.01
5,195,868 A * 3/1993 Plemmons ..... F01D 25/145 29/525.02
6,126,390 A * 10/2000 Bock ..... F01D 11/18 415/115
6,863,495 B2 * 3/2005 Halliwell ..... F01D 11/24 415/173.1
7,210,899 B2 * 5/2007 Wilson, Jr. ..... F01D 11/18 415/136
7,524,164 B2 * 4/2009 Wunderlich ..... F01D 11/18 415/136
8,100,635 B2 * 1/2012 Dakowski ..... F01D 11/005 415/115
9,429,038 B2 * 8/2016 Sahores ..... F01D 21/045
2004/0120803 A1 6/2004 Lucas et al.
2007/0077141 A1 4/2007 Keller
2012/0134780 A1 5/2012 Khanin
2016/0201495 A1 7/2016 Ahmad et al.

FOREIGN PATENT DOCUMENTS

EP 2458152 A2 5/2012
EP 2835504 A1 2/2015
GB 2206651 A 1/1989
JP S5020201 B1 7/1975
JP S63239301 A 10/1988
JP H08277701 A 10/1996

OTHER PUBLICATIONS

JP Office Action dated May 15, 2017, for JP patent application No. 2016516887.
EP Search Report dated Mar. 19, 2014, for EP application No. 13185947.2.
International Search Report dated Nov. 17, 2014, for PCT application No. PCT/EP2014/068359.
CN Office Action dated Aug. 17, 2016, for CN application No. 201480052860.8.
IPPR (PCT/IPEA/416) dated Oct. 9, 2015, for PCT application No. PCT/EP2014/068359.

* cited by examiner

GAS TURBINE AND MOUNTING METHOD

CROSS REFERENCE TO RELATED APPLICATIONS

This application is the US National Stage of International Application No. PCT/EP2014/068359 filed Aug. 29, 2014, and claims the benefit thereof. The International Application claims the benefit of European Application No. EP13185947 filed Sep. 25, 2013. All of the applications are incorporated by reference herein in their entirety.

FIELD OF INVENTION

The present invention relates to a gas turbine and to a mounting method.

BACKGROUND OF INVENTION

It is known and widespread that rotor blade rows of turbines of gas turbines have, at the upper end of the blade airfoils, what is termed a shroud.

A cooled turbine ring segment for a gas turbine is known from US 2004/120803 A1, which segment comprises an axially oriented shroud ring segment having an inner surface, an outer surface, an upstream flange and a downstream flange. The flanges hold the shroud ring in an engine casing. A perforated cooling air impingement plate is arranged on the outer surface of the shroud ring, between the upstream flange and the downstream flange, with an impingement chamber defined between the impingement plate and the outer surface. Axially oriented cooling bores in the ring segment extend between the impingement chamber and an outlet. A hollow adjoining the outlet guides cooling air from the outlet in the direction of a downstream guide vane, in order to cool the guide vane.

EP 0 132 182 A1 shows a seal device for rotor blades of a turbomachine. The seal device comprises section seals. These are, on one hand, attached to an inner ring by means of connection elements and, on the other hand, attached to an outer ring by means of hooks. The inner ring has low thermal inertia and the outer ring has increased thermal inertia. Moreover, the section seals have support ribs on the hooks and centering means.

GB 2 206 651 A presents a turbine blade shroud arrangement which, in operation, surrounds the ends of one stage of turbine blades in a gas turbine engine. The shroud arrangement comprises a ring, which is loosely retained in the axial and radial directions, on a fixed engine structure, a turbine blade shroud having multiple segments abutting laterally against one another, each being hung from a radial face of the ring and positioned in gas sealing and having a relatively movable relationship with respect to the fixed engine structure, wherein the ring is constructed from a material which has slower thermal reaction characteristics than the material of the fixed engine structure.

EP 2 458 152 A2 discloses an axial-flow gas turbine comprising a rotor with alternating rows of air-cooled rotor blades and rotor heat shields, and a stator with alternating rows of air-cooled guide vanes and stator heat shields, which are mounted on inner rings. The stator surrounds the rotor coaxially such that a hot gas path is defined between the stator and the rotor. The rows of rotor blades and stator heat shields, or the rows of guide vanes and rotor heat shields, are arranged opposite one another. One row of guide vanes and the following, downstream row of rotor blades define a turbine stage. The rotor blades are provided with outer blade platforms at their tips. The blade platforms comprise, on their outer side, multiple teeth which run parallel to one another in the circumferential direction and are arranged one behind the other in the direction of the hot gas flow.

The shroud makes it necessary, during work on the rotor blade row which for example takes place for maintenance or testing purposes, to perform what is referred to as a cover lift, that is to say lifting the entire upper casing part. A cover lift is very onerous.

SUMMARY OF INVENTION

The present invention is based on the object of resolving these drawbacks and of providing a gas turbine and a mounting method, such that it is also possible to operate a rotor blade row without a shroud in the gas turbine.

This object is achieved with a gas turbine as claimed and a mounting method as claimed. Advantageous refinements of the invention are specified in the subclaims and described in the description.

Thus, there is advantageously provided a gas turbine which is suitable for operation with a rotor blade row without a shroud. When replacing the rotor blades, it is not necessary to lift off the upper casing of the gas turbine (cover lift). Access from the outlet side is sufficient. The gas turbine according to the invention is thus particularly suitable for testing purposes, which involve more frequent changes to the blade airfoils. The present gas turbine allows these tests to be set up and carried out substantially more quickly.

In addition, the gas turbine according to the invention can easily be converted for operation with a rotor blade row having a shroud, by removing the at least one insert element from the ring segment body.

The ring segment of a turbine of a gas turbine comprises a ring segment body having a hot gas side which, in the mounted state, is oriented toward a hot gas path. The ring segment body has, on the hot gas side, a recess. In the recess there is arranged an insert element of the type described above. In particular, the insert element is screwed to the ring segment body.

The insert element for attaching to a ring segment body of a turbine of a gas turbine is designed to cover a recess. It has a concave front side and a rear side with at least one shaped portion for positioning on the ring segment body. In that context, the recess is arranged on a hot gas side of the ring segment body. The ring segment body is thus designed for operation with a rotor blade row having a shroud.

This arrangement advantageously makes it possible to convert a gas turbine from operation with a rotor blade row having a shroud to operation with a rotor blade row without a shroud. It is possible to save on substantially more onerous new manufacture of a matching ring segment.

In one advantageous embodiment of the insert element according to the invention, the insert element has at least one passage running from the front side to a top side.

Thus, the insert element can be attached to the ring segment body simply using corresponding screws or bolts.

In a further advantageous embodiment of the insert element according to the invention, the insert element has, on the front side, at least one depression arranged coaxially with the passage.

The attachment means, in particular the head of a screw, can thus be sunk into the contour of the insert element.

In a further advantageous embodiment of the insert element according to the invention, the insert element has an upper shaped portion and a lower shaped portion.

The shaped portions serve for quicker, easier and more precise positioning of the insert element prior to securing the insert element to the ring segment body. Installation can thus be carried out more simply and more easily.

The ring segment is thus designed for operation of a rotor blade row without a shroud.

The gas turbine according to the invention comprises a turbine with a rotor blade row and a ring which is made up of multiple ring segments and is arranged around the rotor blade row. In that context, at least one of the ring segments is a ring segment of the type described above.

In the mounting method according to the invention, an insert element is attached to a recess of a ring segment body of a turbine of a gas turbine. In that context, the recess is arranged on a hot gas side which, in the mounted state of the ring segment body, is oriented toward a hot gas path of the gas turbine. In particular, in the mounted state of the ring segment body, the insert element is introduced into the hot gas path and is then fixed to the ring segment body. For example, the insert element is screwed on.

It is thus possible, in particular for test purposes, for a ring segment of a gas turbine to be readily converted from a configuration for operation with a rotor blade row having a shroud to a configuration for operation with a rotor blade row without a shroud. A reverse change is also easily possible.

BRIEF DESCRIPTION OF THE DRAWINGS

Exemplary embodiments of the invention will be discussed in more detail on the basis of the drawings and the following description. In the figures.

DETAILED DESCRIPTION OF INVENTION

Figure 1:
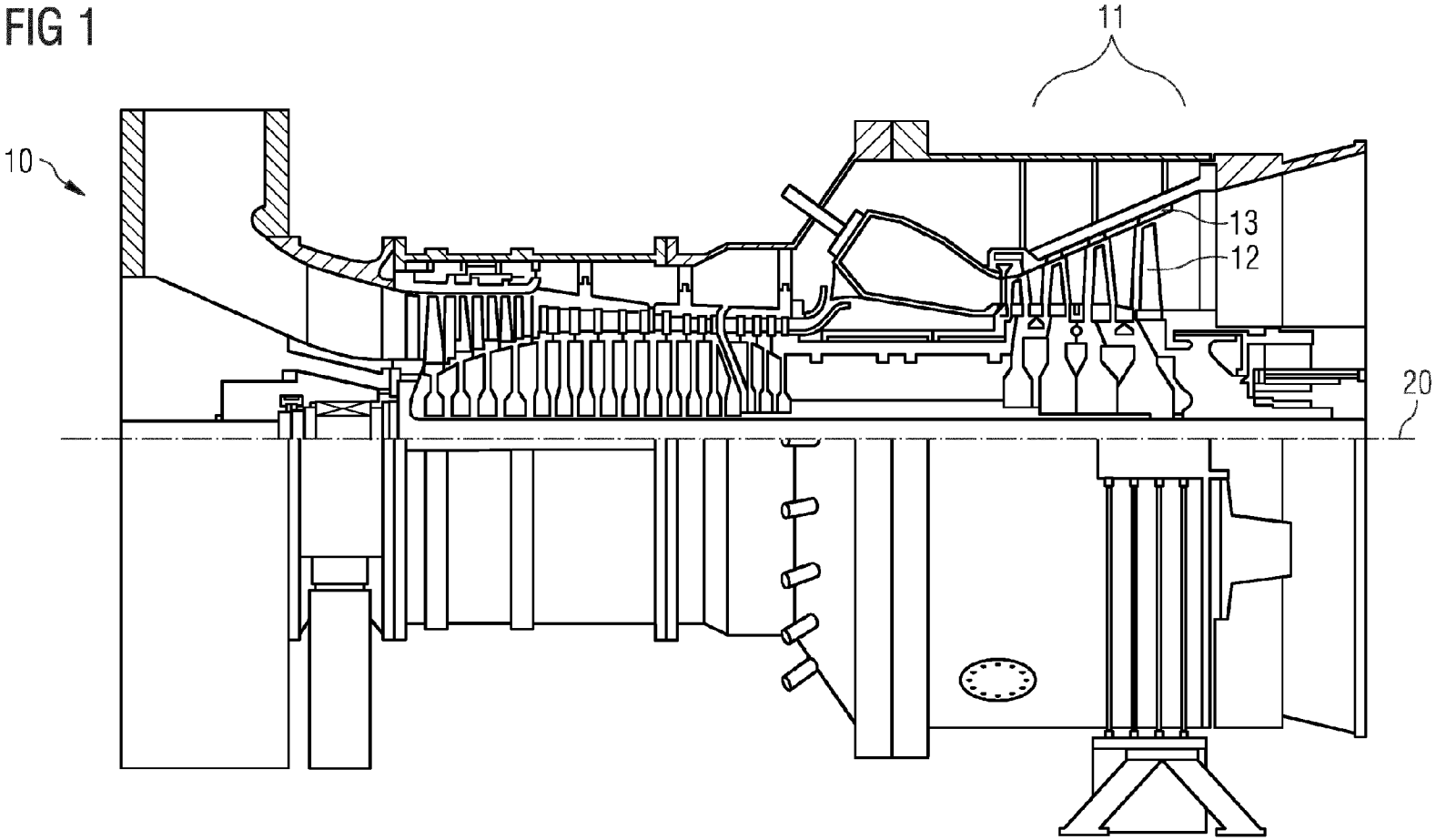
FIG. 1 shows a gas turbine according to the invention.

FIG. 1 shows a gas turbine 10 according to the invention, in an exemplary embodiment. The gas turbine 10 comprises a turbine 11 in which there is arranged at least one rotor blade row 12. Around this rotor blade row 12, there is arranged a ring consisting of multiple ring segments. The rotor blade row 12 is arranged so as to be able to rotate about an axis of rotation 20.

The rotor blade row 12 is in particular the one situated downstream of the other rotor blade rows. In FIG. 1, the corresponding rotor blade row 12 is the fourth rotor blade row of the turbine 11 of the gas turbine 10.

Figure 2:
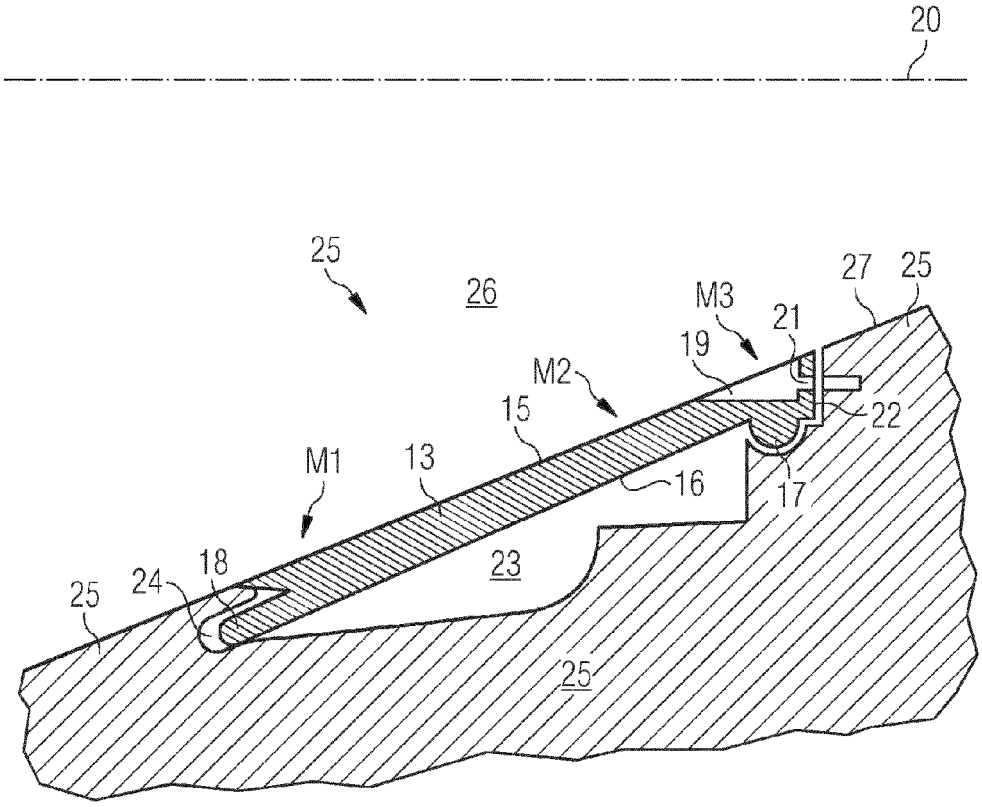
FIG. 2 shows a ring segment according to the invention.

The gas turbine 10 according to the invention has at least one ring segment 13 according to the invention. FIG. 2 depicts a ring segment 13 in an exemplary embodiment.

The ring segment 13 comprises a ring segment body 25 and an insert element 14.

The ring segment body 25 comprises a hot gas side 27. In the mounted state, the hot gas side 27 is oriented toward a hot gas path 26 of the gas turbine 10.

The insert element 14 covers a recess 23 in the ring segment body 25. The recess is arranged on the hot gas side 27. The ring segment body 25 has this recess 23 for operation of the gas turbine 10 with a rotor blade row which has a shroud. In order for it not to be necessary to remove the entire upper casing half of the gas turbine (cover lift), for example during a testing phase, it is advantageous to use the rotor blade row 12 without a shroud. The insert element 14 according to the invention makes it possible for the ring segment body 25 to be adapted to the rotor blade row 12 which has no shroud.

The adaptation takes place by means of a mounting method according to the invention, in which the insert element 14 is fixed to the recess 23. In particular, this can take place while the ring segment body 25 is already mounted in the gas turbine 10. To that end, the insert element 14 is introduced into the hot gas path 26 and is then fixed to the ring segment body 25.

Figure 3:
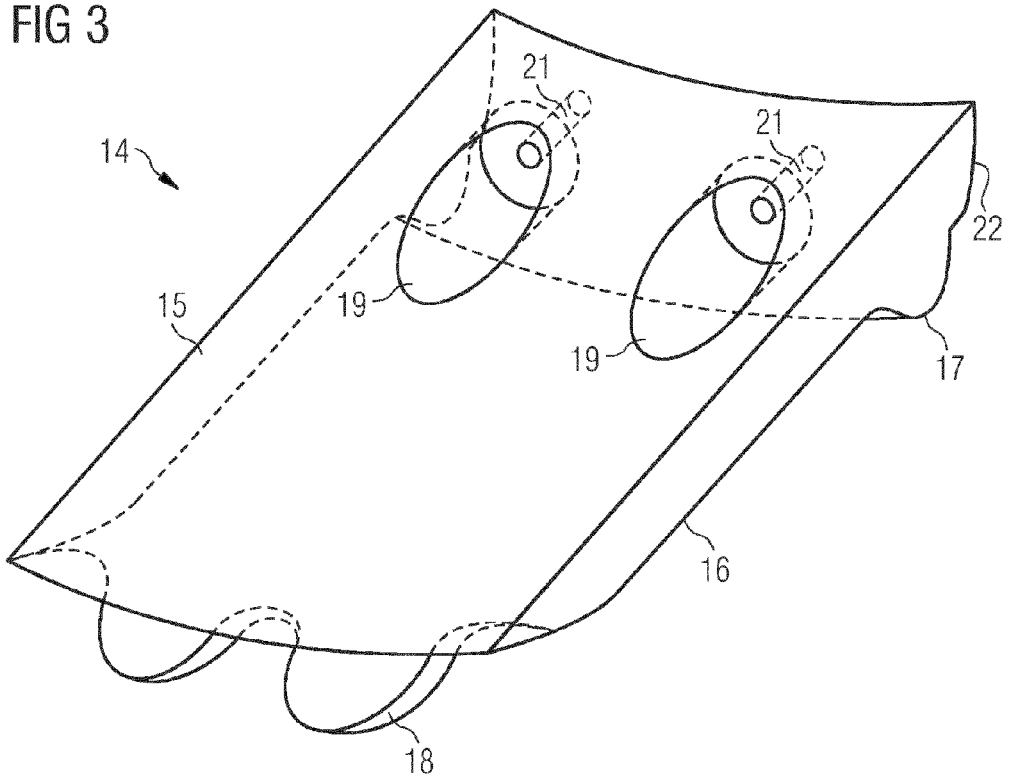
FIG. 3 shows an insert element according to the invention.

FIG. 3 shows the insert element 14 in an exemplary embodiment. The insert element 14 shown in an individual view comprises a concave front side 15 and a rear side 16. In the mounted state, the front side 15 is oriented toward the hot gas path 26. The insert element 14 has, on the rear side 16, at least one shaped portion 17, 18 for positioning on the ring segment body 25.

In the configuration shown, the insert element 14 has one upper shaped portion 17 and two lower shaped portions 18. The lower shaped portions 18 allow the insert element 14 to be pushed into an undercut 24 of the ring segment body 25 in a first mounting step M1. Then, in a second mounting step M2, the insert element 14 can be pivoted onto the ring segment body 25. The upper shaped portion 17 then positions the insert element 14 in its mounting position. The insert element 14 shown has two passages 21, running from the front side 15 to a top side 22. In a third mounting step M3, the insert element 14 can now be screwed to the ring segment body 25. The screwing means are then fed through the passages 21. The insert element 14 is securely connected to the ring segment body 25 after only three mounting steps. In the mounted state, the insert element 14 is preferably flush with the ring segment 13. Mounting the insert element 14 on the ring segment body 25 creates a ring segment 13 according to the invention.

The front side 15 of the insert element 14 according to the invention is concave and thus adapted to the ring segments 13 arranged around the rotor blade row 12. The insert element 14 shown has, on the front side 15, in each case one depression 19 per passage 21. The depressions 19 are in each case arranged coaxially with the passages 21.

Although the invention has been described and illustrated in more detail by way of the preferred exemplary embodiment, the invention is not restricted by the disclosed examples and other variations can be derived herefrom by a person skilled in the art without departing from the scope of protection of the invention.

The invention claimed is:

1. A gas turbine comprising:

a turbine having a rotor blade row and a ring that is arranged around the rotor blade row and is made up of multiple ring segments, wherein at least one of the ring segments comprises a ring segment body having a hot gas side which, in the mounted state, is oriented toward a hot gas path, wherein the ring segment body has, on the hot gas side, a recess and in the recess there is arranged an insert element which is designed to cover the recess, wherein the insert element has a concave front side and a rear side with at least one shaped portion for positioning on the ring segment body, such that the insert element is adapted to be introduced into the hot gas path and then to be attached to the recess of the ring segment body while the ring segment body is already mounted in the gas turbine.

2. The gas turbine as claimed in claim 1,
wherein the insert element has at least one passage running from the front side to a top side.

3. The gas turbine as claimed in claim 1,
wherein the insert element has, on the front side, at least one depression arranged coaxially with the passage.

4. The gas turbine as claimed in claim 1,
wherein the insert element has an upper shaped portion and a lower shaped portion.

5. The gas turbine as claimed in claim 1,
wherein the insert element is screwed to the ring segment body.

6. A mounting method for attaching an insert element to a gas turbine as claimed in claim 1, the method comprising:
attaching an insert element to a recess of a ring segment body of a turbine of a gas turbine,
wherein the recess is arranged on a hot gas side which, in the mounted state of the ring segment body, is oriented toward a hot gas path of the gas turbine.

7. The mounting method as claimed in claim 6,
wherein, in the mounted state of the ring segment body, the insert element is introduced into the hot gas path and is then fixed to the ring segment body.

8. The mounting method as claimed in claim 6,
wherein the insert element is screwed onto the ring segment body.

* * * * *